US007123269B1

(12) United States Patent
Bourdey et al.

(10) Patent No.: US 7,123,269 B1
(45) Date of Patent: Oct. 17, 2006

(54) MODIFYING VECTOR OBJECTS

(75) Inventors: Lubomir D. Bourdey, San Jose, CA (US); Martin E. Newell, Palo Alto, CA (US)

(73) Assignee: Adobe Systems Incorporated, San Jose, CA (US)

( * ) Notice: Subject to any disclaimer, the term of this patent is extended or adjusted under 35 U.S.C. 154(b) by 300 days.

(21) Appl. No.: 10/177,925

(22) Filed: Jun. 21, 2002

(51) Int. Cl.
*G09G 5/02* (2006.01)

(52) U.S. Cl. ..... 345/589; 345/523; 345/582

(58) Field of Classification Search ..... 345/589, 345/643, 586, 594, 582, 423, 427
See application file for complete search history.

(56) References Cited

U.S. PATENT DOCUMENTS

| | | | | |
|---|---|---|---|---|
| 5,592,599 | A * | 1/1997 | Lindholm | 345/427 |
| 6,057,854 | A * | 5/2000 | Davis et al. | 345/619 |
| 6,208,355 | B1 * | 3/2001 | Schuster | 345/442 |
| 6,226,000 | B1 * | 5/2001 | Richens et al. | 345/419 |
| 6,271,861 | B1 * | 8/2001 | Sargent et al. | 345/589 |
| 6,300,955 | B1 * | 10/2001 | Zamir | 382/283 |
| 6,310,622 | B1 | 10/2001 | Asente | |
| 6,313,840 | B1 * | 11/2001 | Bilodeau et al. | 345/423 |
| 6,337,925 | B1 * | 1/2002 | Cohen et al. | 382/199 |
| 6,373,490 | B1 * | 4/2002 | Bendiksen et al. | 345/441 |
| 6,459,439 | B1 * | 10/2002 | Ahlquist et al. | 345/672 |
| 6,476,934 | B1 * | 11/2002 | Ilbery et al. | 358/3.04 |
| 6,549,212 | B1 * | 4/2003 | Janzen | 345/581 |
| 6,628,295 | B1 * | 9/2003 | Wilensky | 345/594 |
| 6,633,300 | B1 * | 10/2003 | Tomack et al. | 345/581 |
| 6,774,907 | B1 * | 8/2004 | Gupta | 345/589 |
| 6,784,896 | B1 * | 8/2004 | Perani et al. | 345/589 |
| 6,795,069 | B1 * | 9/2004 | Raskar et al. | 345/419 |
| 2002/0130908 | A1 | 9/2002 | Wilensky | |
| 2003/0112454 | A1 * | 6/2003 | Woolfe et al. | 358/1.9 |

FOREIGN PATENT DOCUMENTS

CA 2306652 * 10/2000

OTHER PUBLICATIONS

Foley, et al., "Computer Graphics: Principles and Practice, Second Edition in C," 1996, pp. 736-737.*
Hsu et al., "Skeletal Strokes", Proceeding of the ACM Siggraph & Sigchi Symposium on User Interface Software & Technology, Nov. 1993, pp. 197-206.
Image Hose Creation Tutorial, pp. 1-9, http://www.dragoncrafted.com/tutorial/imagehose.htm.
Jay Arraich's Photoshop Tips-6.0 Brushes, pp. 1-5, http://www.arraich.com/ref/aabrushes.htm.
"*Maya Hardware Shader White Paper*," Alias/Wavefront, Toronto, Canada, Sep. 2001, pp. 1-22.

* cited by examiner

*Primary Examiner*—Matthew C. Bella
*Assistant Examiner*—Alysa N Brautigam
(74) *Attorney, Agent, or Firm*—Fish & Richardson P.C.

(57) ABSTRACT

Computer programs and computer-implemented methods implement techniques for applying a modification operation to vector objects in an image. These include receiving user input applying a modification operation in an image, identifying one or more vector objects to be affected by the modification operation and changing one or more attribute values for one or more of the attributes of each identified vector object according to the modification operation. The techniques can also include receiving user input selecting one of a plurality of image processing modes, each of the image processing modes defining a method of changing attribute values for of one or more of the attributes.

In preferred embodiments, feedback is provided to the user of how attribute values for the attributes of vector objects are changing within the image.

58 Claims, 9 Drawing Sheets

MODIFYING VECTOR OBJECTS

BACKGROUND

This application relates to computer-implemented vector illustration programs and methods and techniques for modifying vector objects using such programs and methods.

In conventional computer graphics or illustration programs, such as Adobe® Illustrator®, available from Adobe Systems Incorporated of San Jose, Calif., an image can include multiple graphical elements representing, e.g., shapes, objects or other components of the image. In general, vector illustration programs create and manipulate graphics in which such graphical elements are represented as vector objects that have attributes that define the visual characteristics of the corresponding graphical element in the image, such as location, color, size, shape, orientation, transparency, and the like, based on a set of attribute values. Vector objects describe graphics mathematically, using, e.g., lines and curves that define their geometric characteristics. For example, a bicycle tire in a vector graphic is made up of a mathematical definition of a circle drawn with a certain radius, set at a specific location, and filled with a specific color. Vector objects can be edited—e.g., the location, size, or color attributes can be changed—by changing attribute values associated with the object.

By contrast, many painting and image-editing programs, such as Adobe Photoshop, generate and manipulate bitmap or raster images. Raster images use a grid of pixels to represent graphics, with each pixel having a specific location and color value. A bicycle tire in a bitmap image is made up of a collection of pixels, with each pixel forming part of a mosaic that gives the appearance of a tire. A raster image is edited by editing pixels (i.e., by changing color or opacity values associated with a pixel), rather than objects or shapes.

SUMMARY

The invention features vector illustration programs and methods in which a user specifies a modification operation to be applied at one or more locations in an image that includes graphical elements represented by vector objects. Based on user input, one or more graphical elements are identified that will be affected by the specified modification operation. The modification operation is operable to define a spatially-dependent change in visual characteristics of affected graphical elements by changing attribute values of the corresponding vector objects relative to the vector objects' location in a region of influence. For each identified graphical element, the relevant attribute value or values of the corresponding vector object are changed according to the specified modification operation.

In general, in one aspect, the invention features computer-implemented methods and apparatus, including computer program apparatus, implementing techniques for processing one or more vector objects representing graphical elements in an image. The vector objects are defined by one or more object-level attributes which define one or more visual characteristics of the vector objects independent of location within the vector object. User input applying a modification operation in the image is received. One or more vector objects to be affected by the modification operation are identified relative to a region of influence of the modification operation. One or more attribute values for one or more of the object-level attributes of each identified vector object are changed according to the modification operation, whereby the degree of change is defined based at least in part on an influence function associated with the modification operation.

Particular implementations can include one or more of the following features. Based on the user input, an intensity representing a strength of the modification operation can be defined at one or more locations in the region of influence. Attribute values for object-level attributes of each identified vector object can be changed based at least in part on the intensity. The region of influence can be an aggregate region of influence defined based on a plurality of applications of the modification tool in the image. The influence function can be an aggregate influence function defined based on a plurality of applications of the modification tool in the image. The intensity can be an aggregate intensity defined based on a plurality of applications of the modification tool in the image. Attribute values for object-level attributes of each identified vector object can be changed at a location in the image based at least in part on a value for the aggregate influence function and a value of the aggregate intensity defined for the location in the image.

User input selecting one of a plurality of image processing modes is received, whereby each of the image processing modes define a method of changing attribute values for one or more of the object-level attributes. Attribute values for object-level attributes of each identified vector object can be changed based at least in part on the selected image processing mode. The plurality of image processing modes can include a randomization mode, smoothing mode, and a sharpen mode. A random attribute value can be generated when attribute values for the object-level attributes of each identified vector object are changed according to the selected image processing mode. According to the selected image processing mode, attribute values for object-level attributes of each identified vector object can be changed relative to an average attribute value of a object-level attribute (e.g., towards or away from the average attribute value). The average attribute value for a object-level attribute of a given vector object can be calculated by determining a distance in the image between the location of the vector object and a location of each of a plurality of other vector objects in the image, and calculating the average attribute value for the object-level attribute at the location of the vector object based on an attribute value for the object-level attribute for each of the plurality of other vector objects and the distance between the location of the vector object and the location of each of the plurality of other vector objects in the image.

Attribute values for a plurality of object-level attributes of each identified vector object can be changed. The modification operation can be operable to modify object-level attributes, including, for example, color, tinting, size, orientation, oriented scale, style, transparency, and paint order. The influence function can be defined by a mask to be applied to the image. The strength of the modification operation at a given location in the image can be defined by a mask value for the given location. Attribute values for an oriented-scale attribute of each identified vector object can be changed, whereby the oriented-scale attribute includes one or more scale values representing a size of the corresponding vector object and one or more orientation values representing angles at which the scale attribute values are to be applied to the corresponding vector object. Attribute values for a tinting attribute can be changed. The tinting attribute includes for a given vector object a tint color value defining a tint color, a tinting-amount value defining a degree of tinting to be applied to the vector object, and a tinting function defining a result color for the vector object as a function of the tint color value of the vector object and an original color value of the color attribute of the vector object. The tinting attribute of the tinted colors for a given vector object can be applied to generate one or more tinted colors for the vector object based on the original color values of the vector object, the tinting function and the tinting-amount.

Attribute values for a tinting attribute can be interpolated between the original color value of each of the vector object's color attribute and the result color defined by the tinting function using the tinting amount according to the formula: finalColor=[(1−tintAmount)·origColor+tintAmount·resultColor], where finalColor is a value of the generated tint color, tintAmount is the tinting-amount, origColor is the original color value, and resultColor is the result color value produced by the tinting function. Attribute values for a paint-order attribute of each identified vector object can be changed, whereby the paint-order attribute includes one or more attribute values defining the order in which the vector object is painted in the group of vector objects when rendering the image. The user input can include input representing manipulation by a user of a modification tool defining the modification operation. Real-time (or near real-time) feedback of the changing attribute values can be provided to the user. A temporary visual representation of an attribute value for a vector object can be displayed within a footprint of the modification tool. The visual representation of the attribute value can be changed in response to the user's manipulation of the modification tool. The influence function can be defined at least in part by attribute values of a user-selected object in the image. The user input applying the modification operation can define one or more values for an input parameter derived from the user input. New attribute values for object-level attributes of each identified vector object can be calculated based at least in part on a value of the input parameter defined at the location of the identified vector object in the image. The input parameter can include one of direction, speed, pressure, and tilt. The object-level attributes can be vectors.

In general, in another aspect, the invention features computer-implemented methods and apparatus, including computer program apparatus, implementing techniques for processing vector objects having visual characteristics defined by one or more attribute values for one or more attributes in an image. User input applying a modification operation in the image is received. User input selecting one of a plurality of image processing modes is received, whereby each of the image processing modes define a method of changing attribute values for of one or more of the attributes. One or more vector objects to be affected by the modification operation are identified relative to a region of influence of the modification operation. One or more attribute values for one or more of the object-level attributes of each identified vector object are changed according the modification operation and the selected image processing mode, whereby the degree of change for each of the identified vector objects is defined based at least in part on the influence function and the method of changing attribute values.

Particular implementations can include one or more of the following features. The plurality of image processing modes can include a randomization mode, a smoothing mode, and a sharpen mode. A random attribute value can be generated when attribute values for the attributes of each identified vector object are changed according to the selected image processing mode. According to the selected image processing mode, attribute values for the attributes of each identified vector object can be changed relative to an average attribute value of an attribute. According to the selected image processing mode, attribute values for attributes of each identified vector object can be changed relative to an average attribute value of an attribute (e.g., towards or away from the average attribute value). The average attribute value for an attribute of a given vector object can be calculated by determining a distance in the image between the location of the vector object and a location of each of a plurality of other vector objects in the image, and calculating the average attribute value for the attribute at the location of the vector object based on an attribute value for the attribute for each of the plurality of other vector objects and the distance between the location of the vector object and the location of each of the plurality of other vector objects in the image. The attributes can be vectors.

Advantages that can be seen in implementations of the invention include one or more of the following. Vector objects in a digital image can be painted and edited using intuitive brush-like modification tools while maintaining a vector model of the vector objects and their attributes. Modification tools can be configured to operate on a variety of attributes as well as object-level appearance attributes, including orientation, color, opacity, transparency, and the like. The user can change the footprint, or region of influence, of the modification tool. The selected modification tool can affect all vector objects that lie within a region of influence created by the movement of the tool. A single application of the modification tool can affect different vector objects differently. The user can also control the degree of change for the attributes, that is, how much the attributes of vector objects affected by a given movement of the tool. Defining dependencies between operations and attribute values of different vector objects allows a user to quickly change the appearance of a vector object, or a group of one or more vector objects. These advantages, by themselves or in combination, give the user great flexibility and add new ways of editing vector objects in digital images. The editing tools also provide a more intuitive way of modifying vector objects than conventional vector-based tools do.

The details of one or more embodiments of the invention are set forth in the accompanying drawings and the description below. Other features of the invention will be apparent from the description and drawings, and from the claims.

DESCRIPTION OF DRAWINGS

Like reference symbols in the various drawings indicate like elements.

DETAILED DESCRIPTION

Figure 1:
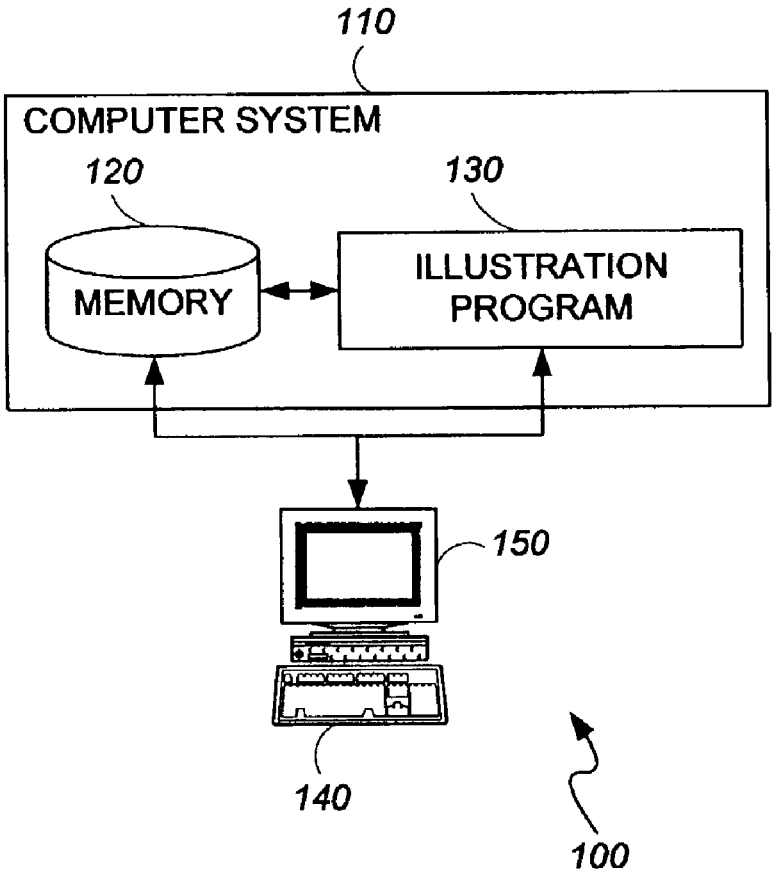
FIG. 1 is a block diagram depicting a graphical illustration system suitable for use in implementations of the present invention.

FIG. 1 illustrates graphic illustration system 100 that includes a general-purpose programmable digital computer system 110 of conventional construction, including a memory 120 and a processor for running an illustration program 130, which can be implemented in a conventional vector illustration program such as Adobe® Illustrator®, available from Adobe Systems Incorporated of San Jose, Calif. Graphics illustration system 100 also includes input devices 140, such as a keyboard, mouse or digitizing pen, and output devices such as a display monitor 150. Optionally, graphics illustration system 100 also includes conventional communications hardware and software by which computer system 110 can be connected to other computer systems, such as over a network.

Figure 2:
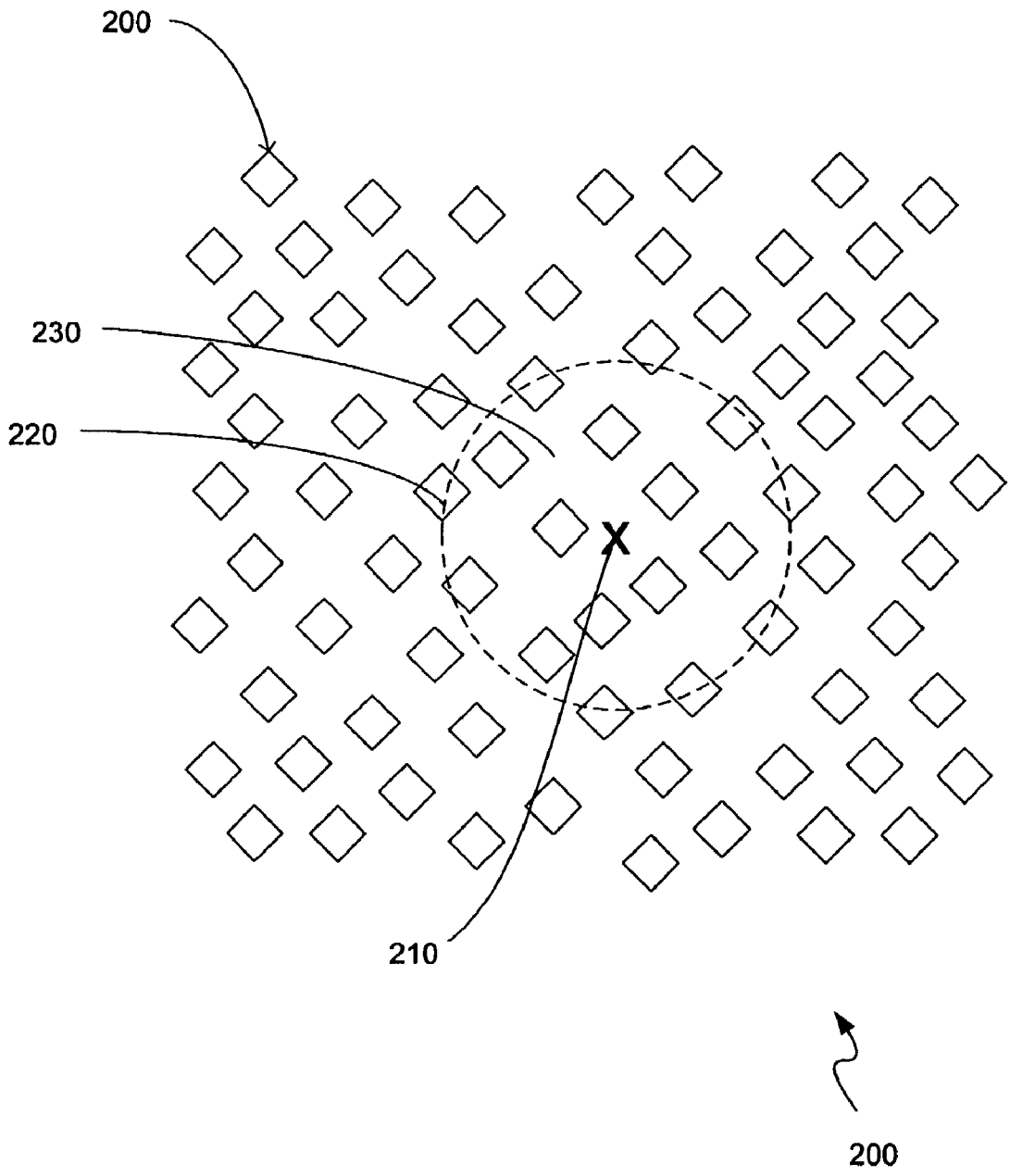
FIG. 2 illustrates the application of a modification tool to a collection of vector objects.

FIG. 2 shows an image that includes a collection of vector objects 200 that can be generated in illustration program 130. As used in this specification, an image can represent a single, unitary visual illustration or representation, or a portion of such an illustration or representation. The vector objects 200 shown in FIG. 2 are in a two-dimensional space, but the techniques described herein can be applied to vector objects in any number of dimensions that are viewable by a projection in a two-dimensional environment. Each vector object 200 includes one or more attributes that define visual characteristics of the vector object. The attributes can be object-level attributes, which, as used herein, refers to attributes that define a corresponding visual characteristic of each of the vector objects independent of location within the vector object—that is, attributes that define a corresponding visual characteristic according to a constant attribute value that applies to the entire vector object, or according to a variable attribute value that varies as a function of some property other than location within the vector object. Vector objects 200 can also include attributes that define visual characteristics in a location-dependent fashion—that is, according to attribute values that vary as a function of location within the object. Examples of such attributes, which are not considered to be object-level attributes as that term is used herein, include attributes that define object visual characteristics according to attribute values that are parameterized along a path.

Thus, for example, the vector objects 200 can have object-level attributes that include, color, size, orientation, style, transparency, and the like defined independent of location within each vector object. Each attribute can have one or more attribute values that quantify the amount of the visual characteristic to be displayed in the electronic document. Attributes can be scalar attributes, or vector attributes. Each attribute can be represented by scalar form, a vector, or a combination of both.

Thus, for example, a vector object's location in an image may be defined by a pair of attribute values for a location attribute, representing x and y coordinates in the image; similarly, a vector object's color can be defined by one or more color values representing a color—for example, a single color value representing a shade of gray, a set of three color values representing RGB color values or the like.

A vector object's initial attribute values can be assigned based on user input, or can be derived from pre-determined or default values, and can be fixed (i.e., not subject to alteration based on subsequent user input or operations in illustration program 130) or variable (changeable based on user input or drawing operations). A vector object's visual appearance is defined by a set of current attribute values (e.g., at the time the vector object is to be displayed). The visual appearance of a vector object can be made to depend on the visual appearance of one or more other vector objects by defining relationships between the vector objects as described in contemporaneously filed U.S. patent application—"Creating and Manipulating Related Vector Objects in an Image" by Lubomir Bourdev and Martin Newell, which is incorporated by reference in its entirety.

FIG. 2 also illustrates the application of a modification tool represented by a tool footprint 230 to the collection of vector objects 200. Illustration program 130 provides one or more modification tools that can be used to modify the appearance of vector objects in an image. A modification tool applies a user-specified modification to an attribute value or values of one or more selected vector objects in the image. Each modification tool is characterized by an area or footprint that defines a region of influence when the modification tool is applied to an image. The region of influence determines which vector objects in the image will be affected by a given application of the modification tool. In some implementations, the tool footprint is defined by a size and/or a shape, either or both of which can be variable for a given application of the modification tool, such as in response to user input as will be described in more detail below. When the modification tool is applied at a location in an image, the region of influence is determined based on the application (e.g., overlay) of the tool footprint at the location, and may represent the accumulation of multiple applications (e.g., "stamps") of the footprint at a succession of locations as the tool is manipulated in a user interface of illustration program 130.

In other implementations, the tool footprint (and region of influence) can be defined by a mask defining a masked region or regions and an unmasked region or regions, such that when the mask is applied to an image the relevant attribute value or values of any vector objects in the unmasked region of the image are changed, while the attribute values of vector objects located in the masked region remain unchanged (or vice versa).

Each modification tool can also be characterized by an influence function that defines the spatial distribution of the affect of the modification tool—that is, how attribute values of affected vector objects at a given location in the footprint (e.g., those vector objects within the tool's region of influence when the tool is applied to an image) will change as a function of the location. The influence function can be any predetermined or user-defined function, including constant functions, uniform variable functions, Gaussian functions, or arbitrary functions defined by user input. This can include input directly specifying a function or input indirectly specifying a function—e.g., selecting an image, object, or group of objects and defining the influence function as a function of one or more attribute values of the selected image, object, or group of objects.

Thus, for example, a modification tool can have a constant influence function specifying that a particular attribute value or values of any affected vector objects will be increased (or decreased) by a constant amount. Alternatively, an influence function can define a variable attribute value change of affected vector objects that will vary based on the location of each affected vector object relative to the region of influence. In implementations in which a mask defines the region of influence, the influence function can define multi-bit mask values at locations in the mask, which illustration program 130 can use to set attribute values for vector objects located at corresponding locations in the image (either absolutely or relatively, by altering existing attribute values based on mask values or a weighted average of mask values around the corresponding location). For example, orientation attribute values of vector objects can be set according to a luminosity gradient of a mask (or its perpendiculars). As with size and shape, the influence function of a modification tool can be variable in response to user input.

Each modification tool can also have an associated intensity that defines the strength of a given application of the modification tool—in other words, how much attribute values of affected vector objects (e.g., those vector objects within the tool's region of influence when the tool is applied to an image) will change as a result of the application of a modification tool to an image. The intensity of the modification tool can be constant, or variable. The intensity can also be user defined—e.g., based on pressure applied to a pressure-sensitive stylus, or the speed or direction in which a stylus or mouse pointer is moved, or the number of times that a mouse button is clicked, or the like. Where the operation involves multiple applications of the modification tool the intensity can be an aggregate intensity, based on the combined intensities for each discrete application of the modification tool.

In some implementations, modification tools can be manipulated using conventional graphical input techniques, such as user manipulation of a mouse, stylus or arrow keys, to apply the modification tool at one or more locations in an image. In response to user input manipulating a modification tool in this way, illustration program 130 changes one or more attribute values of vector objects based on their locations in the image relative to the location or locations of the modification tool. Thus, for example, in response to the application of a modification tool at a location in an image, illustration program 130 may identify a region of influence corresponding to the application of the tool footprint at the location, and increase attribute values for a specified attribute for all vector objects that fall within the region of influence by an amount determined by the tool's influence function and intensity. The effect of the modification tool as applied can also be altered—for example, by changing the size or shape of the tool footprint or by changing the influence function or intensity—in response to the user's manipulation of the tool.

The tool footprint (and resulting region of influence), influence function, and intensity of a given modification tool can be visually represented in illustration program 130 by, for example, a shape displayed in an image representing the tool footprint at a location in the image at which the modification tool is being or will be applied. Thus, for example, FIG. 2 illustrates an application of a modification tool to vector objects in a collection of vector objects 200. As illustrated, the modification tool is represented by a cursor 210 representing the location of the tool (e.g., the location of a mouse pointer or stylus being manipulated by the user) and a dotted shape (here a circle) 220 defining the tool footprint 230. In this example, the intensity of the modification tool is represented by the opacity of the circle 210, such that a tool instance that will cause larger attribute value change to attribute values of vector objects within a corresponding portion of the region of influence will be represented by a circle defined by a "more opaque" (or "less dotted") line than a tool instance that will cause a smaller change in the attribute values of affected vector objects. The intensity of the modification tool can be visually represented in many other ways. For example, the various degrees of transparency of the perimeter of the modification tool, or the number of concentric lines about the perimeter of the tool, and the like, can represent the intensity of the tool. Likewise, the tool's influence function can be visually represented—such as by a color or gray-scale gradient fill within the shape representing the tool footprint, such that the influence function value at a given point is represented by the color value of the gradient fill at that point. Thus, a tool can be configured to provide for a variable attribute value change in response to one or more values for an input parameter derived from the user input. Such input parameters can include, for example, pressure applied to a pressure-sensitive stylus, or the speed, direction, or tilt in which a stylus or mouse pointer is moved. The visual representation of the modification tool can illustrate the tool's effect at any given time by changing how the tool's footprint is represented.

Figure 3:
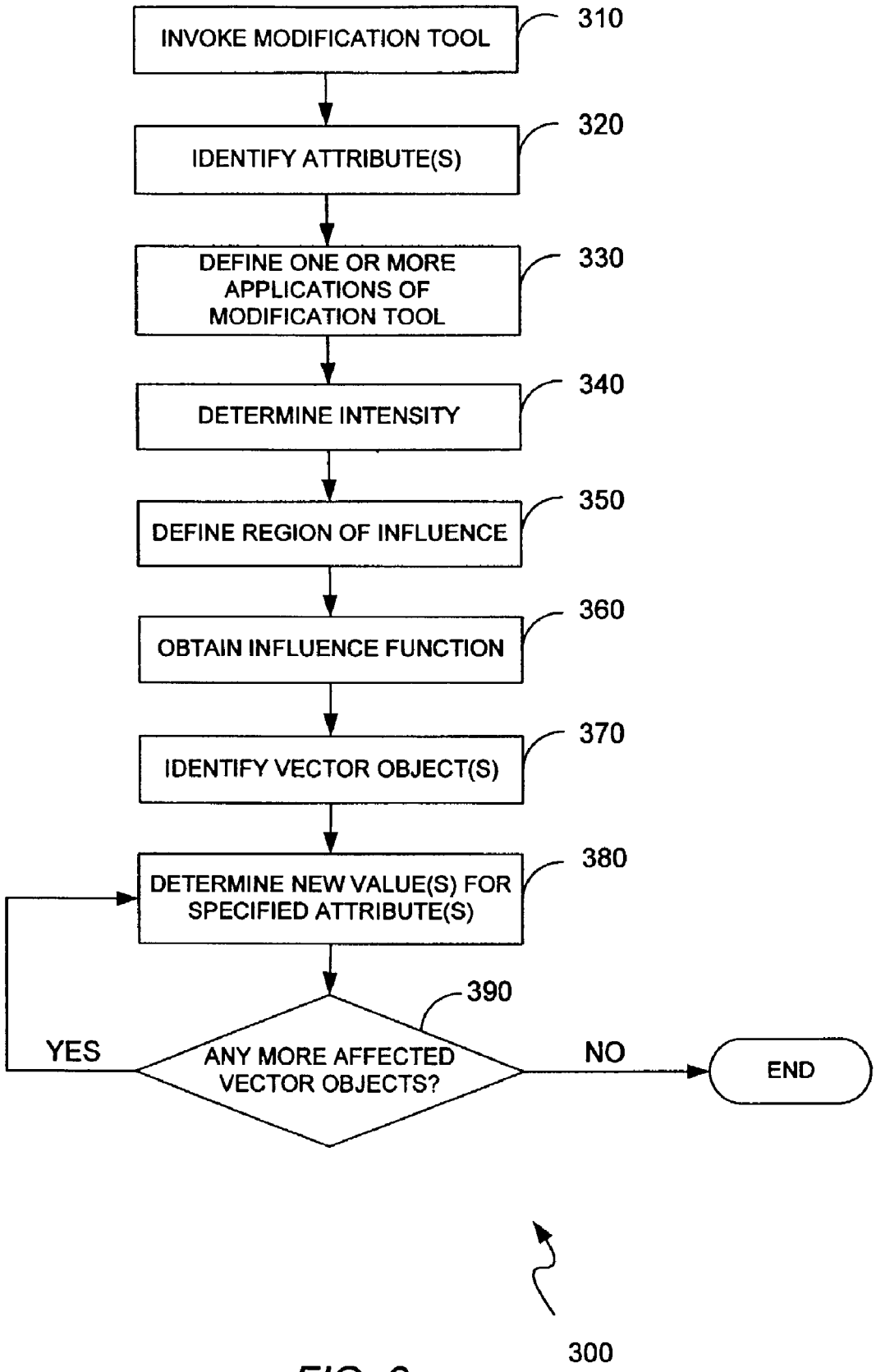
FIG. 3 is a flow diagram illustrating a method for modifying attribute values for one or more vector objects in an image.

FIG. 3 illustrates a method 300 implementing a modification operation changing vector object attribute values using modification tools implemented in illustration program 130. The method begins when a user invokes a modification tool (step 310)—for example, by selecting an icon or menu item corresponding to a desired modification tool in a user interface of illustration program 130. Illustration program 130 can be configured to provide a number of specialized modification tools that each operate on one or more particular attributes—e.g., one tool (e.g., a paintbrush) that alters the color of affected vector objects, another that alters the location of affected objects, and so on. Alternatively (or in addition), illustration program 130 can provide modification tools that can operate on one or more attributes selected by the user, or on multiple attributes simultaneously, as will be described in greater detail below.

Illustration program 130 identifies an attribute or attributes (step 320). If illustration program 130 is configured to provide multiple specialized (e.g., attribute-specific) modification tools, the attribute(s) can be identified based on the tool selected by the user; alternatively, the user can select an attribute separately—for example, when a generic tool is invoked, illustration program 130 can be configured to prompt the user to select an attribute or attributes on which the selected tool will operate.

Illustration program 130 receives a user input defining one or more applications of the selected modification tool (step 330). The user input can take the form of a gesture or motion of a graphical input tool, such as a mouse click or click and drag operation, or a stylus stroke on a digitizing tablet. The modification tool can, for example, be moved by the user by moving the mouse while holding down a mouse button, thereby defining a series of applications of the modification tool (e.g., at predetermined or variable intervals) along the path defined by the mouse motion. For each application of the modification tool, illustration program 130 determines an intensity (step 340). The intensity can be determined based on the selected modification tool (e.g., if the tool has a predetermined intensity), and, optionally, based on the user input received in step 330, such as based on pressure applied to a stylus at each application of the tool.

Illustration program 130 defines a region of influence (step 350). The region of influence can be defined based on the selected modification tool and the user input defining the application or applications of the tool, as in an accumulation of a number of discrete instances of a brush footprint as a stylus or mouse cursor is moved across an image, the unmasked (or masked) region of a mask, or the like. As discussed above, the footprint for each of the individual instances can itself vary based on the input—for example, changing size or shape based on the speed with which the mouse or stylus is moved, or the pressure exerted on a pressure-sensitive stylus. Where the operation involves multiple applications of the modification tool the region of influence can be an aggregate region of influence, based on the combined regions of influence for each discrete application of the modification tool.

Illustration program 130 also obtains an influence function that defines the strength of the modification operation as a function of location in the region of influence (step 360). If the modification operation involves only a single application of the modification tool, this influence function can simply be the influence function for the modification tool, as described above. Where the operation involves multiple applications of the modification tool the influence function can be an aggregate function, based on the combined influence functions for each discrete application of the modification tool.

Based on the region of influence, illustration program 130 identifies the vector objects that are affected by the operation (step 370). Affected vector objects are identified based on their location relative to the region of influence. For example, a given operation may affect any vector object that is located within the region of influence. A given operation can be configured to affect only vector objects that are located completely within the region of influence. Alternatively, an operation may affect any vector object any part of which falls within the region of influence.

For each of the affected vector objects, illustration program 130 determines a new value or values for the specified attribute(s) (step 380). Illustration program 130 determines the new attribute value(s) for a given vector object based on the influence function and intensity at the location of the vector object in the region of influence.

This modification step will be now described by way of an example involving a single application of a modification tool having a circular region of influence that has a radius, an intensity and an influence function, which in this example defines the change in the value of an attribute as a distance percentage from the center of the modification tool. Let AmountOfEffect be described by:

AmountOfEffect=InfluenceFn(DistanceFrom ToolCenter/BrushRadius)*BrushIntensity where AmountOfEffect is the amount an attribute of a vector object is changed in response to the region of influence;

InfluenceFn defines the change in the value of an attribute as a distance percentage from the center of the modification tool;

DistanceFromToolCenter is the distance of the corresponding vector object from the center of the modification tool;

BrushRadius is the radius of the modification tool; and

BrushIntensity indicates the intensity (or strength) of the modification tool.

Illustration program 130 then moves to the next affected vector object (the YES branch of step 390). When new attribute values have been determined for all affected vector objects (the NO branch of step 390), the operation is complete.

Figure 4A:
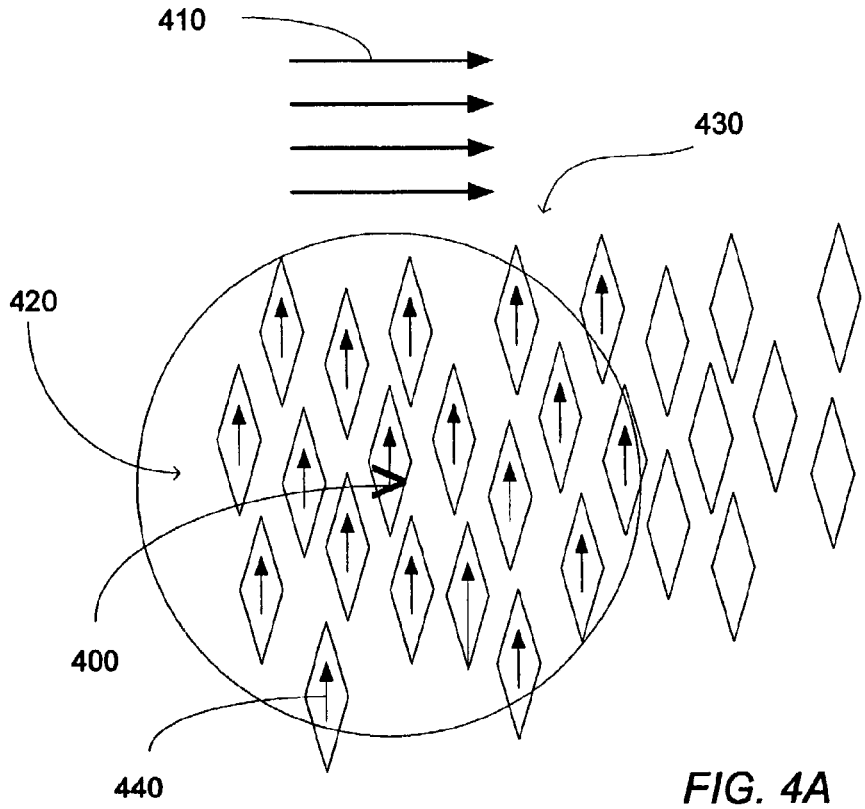
FIGS. 4A–4C illustrate visual feedback provided to a user while using an orientation modification tool to change the orientation of selected vector objects in a collection of vector objects.
Figure 4B:
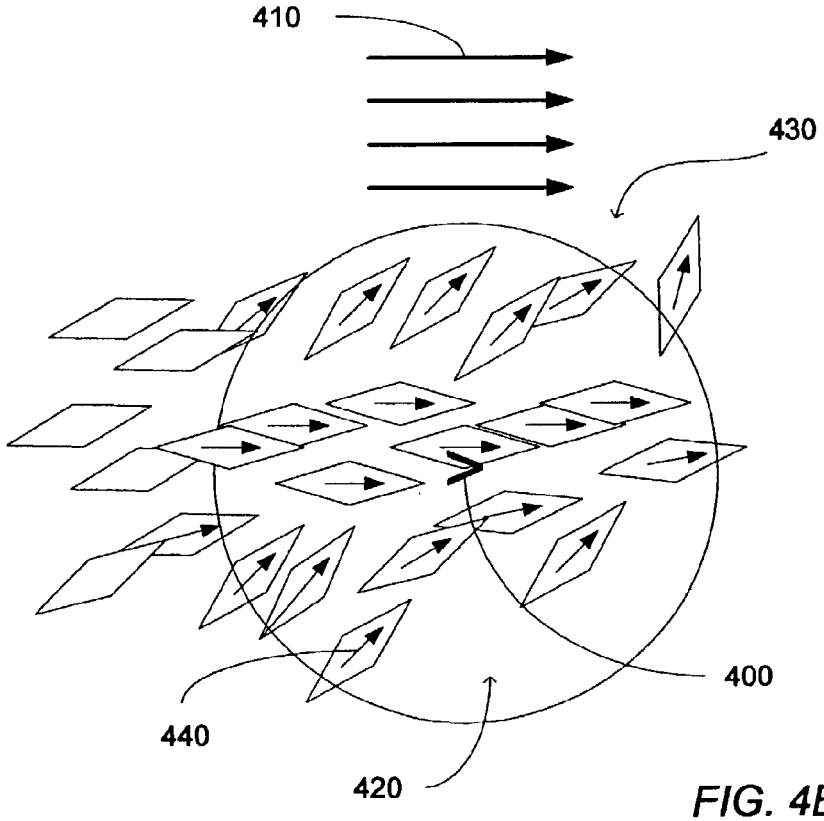
Figure 4C:
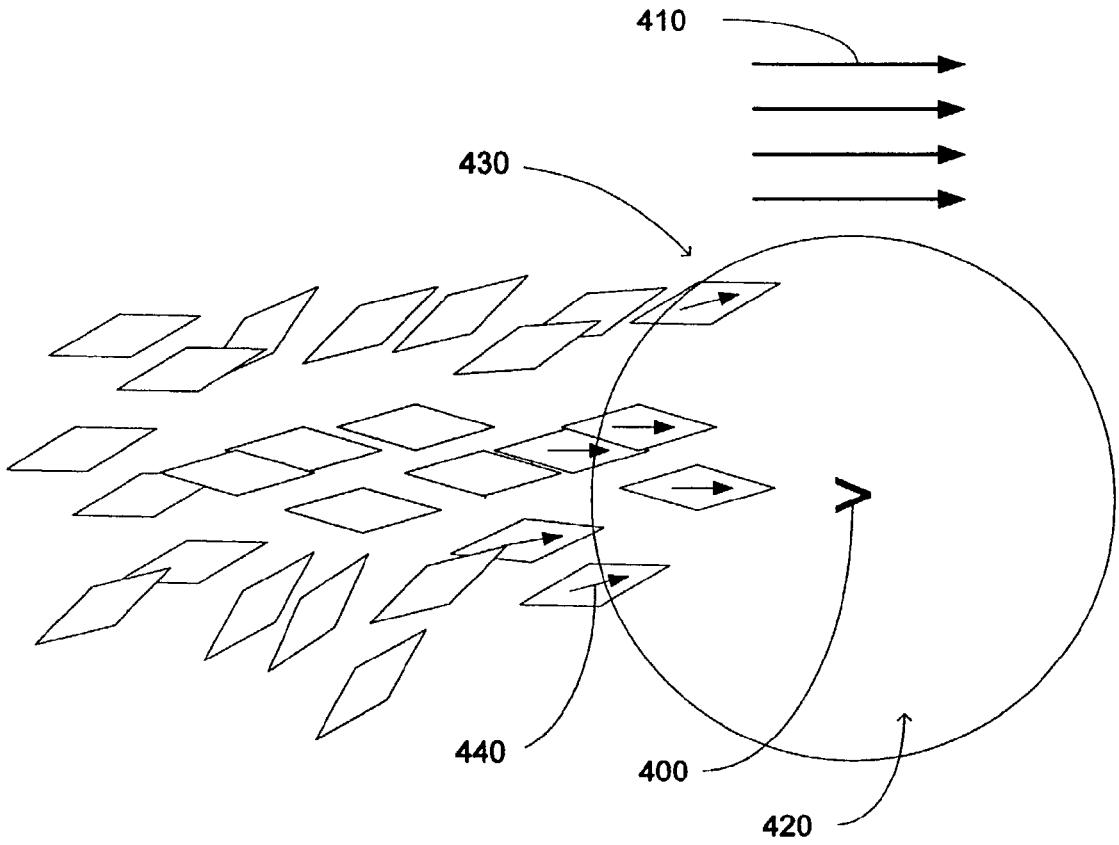

Illustration program 130 can be configured to provide feedback to the user of how the attributes of the affected vector objects are being modified or edited. The feedback provided to the user can be any sensory feedback, such as visual, auditory, or haptic feedback. In some implementations, the feedback provided to the user can take the form of temporary visual cues representing current attribute values of affected vector objects in the region of influence (or tool footprint of the modification tool). The temporary visual cues can be provided in any number of forms which may provide a user with visual feedback of how one or more identified attributes of affected vector object are being modified. The temporary visual cues can be provided in real-time (or near real-time) during a user-controlled gesture of the modification tool giving the user a preview of the modification to the identified attributes of the affected vector objects. In some implementations a slider (or other graphic) can be used to indicate the amount of change of an attribute from its previous value (or from any other attribute value which can be used as a reference value). For example, if the orientation of vector objects 400 as shown in FIG. 4A are modified with an orientation modification tool (represented by footprint 420) in the direction indicated by the arrows 410, visual feedback can be provided in the form of arrows 440 superimposed over each vector object 430 currently within the footprint of the modification tool. As the tool is moved across the collection of vector objects, the arrows 440 move to indicate how the orientation of the corresponding vector object is being changed by the modification operation, as shown in FIGS. 4B and 4C. Optionally, illustration program 130 can be configured to permit the user to reject the modification operation at any time during the operation, in which case the attribute values of the affected vector objects can revert to their pre-operation state.

Figure 5:
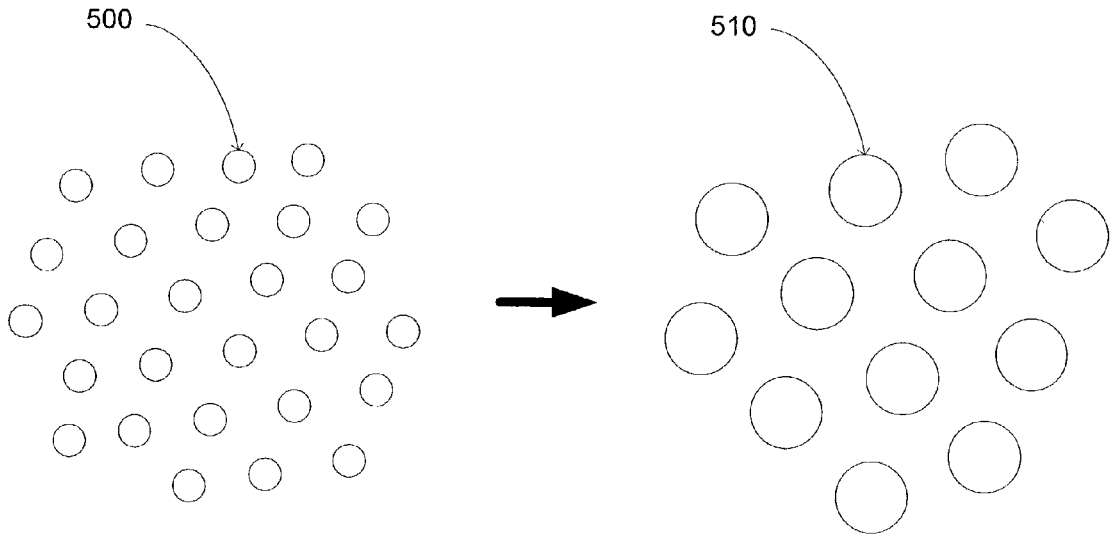
FIG. 5 illustrates the application of a modification tool to a collection of vector objects in a modification operation in which the density of the vector objects is preserved.

As mentioned above, illustration program 130 can be configured to provide modification tools capable of operating on multiple attributes in a single operation. Such modification tools can be configured to change attribute values for each of a plurality of attributes based on a single influence function; alternatively, two or more different influence functions can be provided, such that changes in attribute values of a first attribute will be determined based on one influence function, while changes in attribute values of a second attribute will be determined based on a different influence function. In addition, illustration program 130 can provide modification tools capable of combining multiple operations into a single modification operation, and to define dependencies between such operations. For example, referring to FIG. 5, each of a plurality of circular vector objects 500 can have a scale attribute that defines the size of the object (e.g., the diameter of each circular object 500) and a density attribute that defines a required spacing between the vector object and its nearest neighbor or neighbors in the image. In one implementation, illustration program 130 can be configured to provide a modification tool that is operable to change the scale attribute values of affected vector objects while maintaining an inverse relationship between the scale value for a given vector object and the value for the spacing attribute of that object. Application of such a tool to vector objects 500 can give a modified set of vector objects 510, such that a constant density of vector objects is preserved.

Illustration program 130 can be configured to provide for multiple image processing modes. Image processing modes define how the attribute value or values of affected vector objects will be changed by a given application of a modification tool. A variety of image processing modes can be provided, and a single modification operation can incorporate attribute value changes based on two or more different image processing modes. For example, an attribute value for an attribute can be sequentially changed according to two different image processing modes; similarly, an attribute value for a first attribute can be changed according to a first image processing mode, and an attribute value for a second attribute can be changed according to a second image processing mode.

In an increase mode, the relevant attribute value or values of any affected vector objects are increased by a proportion (or percentage) as determined by the influence function. Similarly, a decrease mode can provide for the decrease of the relevant attribute value or values for affected vector objects. In a blending mode, the attribute value or values of affected objects can be blended with a target value or values, with the contributions of the target and current attribute values to the blend being determined by the influence function. Additional image processing modes can include a randomization mode, a sharpen mode, and a smoothing mode.

Figure 6:
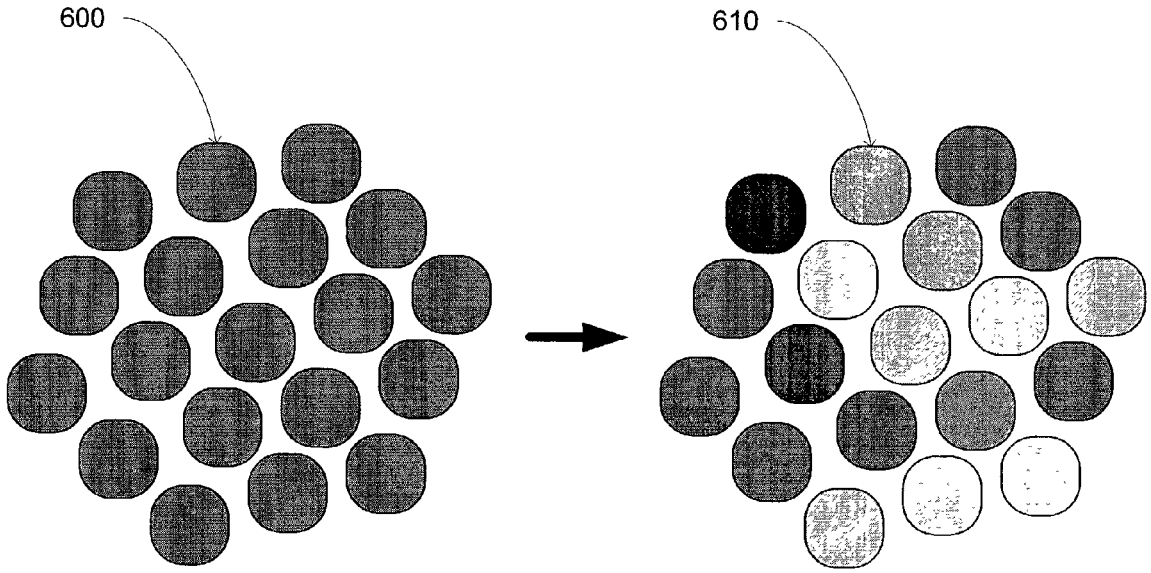
FIG. 6 illustrates the application of a modification tool to a collection of vector objects in a modification operation in which the color of the vector objects is randomized.

In a randomization mode, illustration program 130 is configured to alter the relevant attribute value or values of each affected vector object by a random proportion from the current value. Thus, for example, referring to FIG. 6 the application to vector objects 600 of a color modification tool operating in a randomization mode can give modified vector objects 610, in which the color attribute value for each of the affected vector objects has been changed by a random amount (the random colors appearing as differing shades in FIG. 6). Furthermore, the degree of randomization depends on the influence function. For example, when applying a color modification tool operating in randomization mode on a brown-colored set of objects, a small influence will generate small variations of brown and a large influence will generate variations in all colors.

In a smoothing mode, illustration program 130 applies a modification tool to change the attribute value or values of each affected vector object (by a proportion determined by the influence function) towards an average value of the attribute, which can include, for example, a global average value or the average value of the attribute calculated at the location of the vector object. For example, the local average F(x, y) of an attribute F at location (xy) can be calculated as the average of the values of the attribute $F_1$ for each graphical element i weighted by an amount based on the graphical element's distance from (x,y). Preferably, a local average of an attribute can be defined using the values of the attribute of graphical elements within a predetermined distance, R, from (x,y). The weight of a graphical element can be the difference between $R^2$ and the squared distance from the graphical element to (x,y) as follows:

$$F(x, y) = \frac{\sum_{i=1n} Fi \cdot (R^2 - (x - x_i)^2 - (y - y_i)^2)}{\sum_{i=1n} (R^2 - (x - x_i)^2 - (y - y_i)^2)}$$

Figure 7:
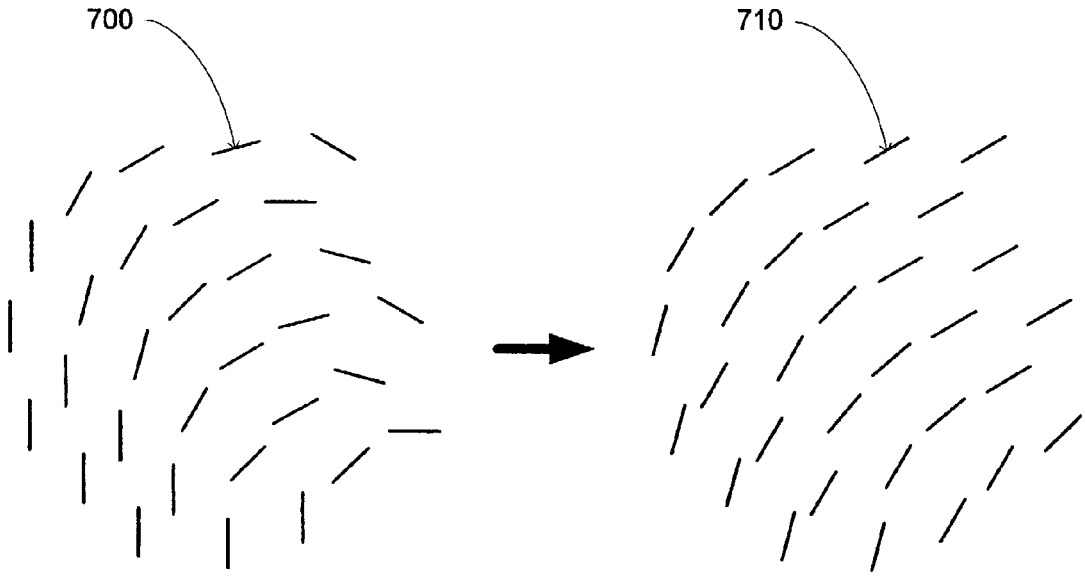
FIG. 7 illustrates the application of a modification tool to a collection of vector objects in a modification operation in which the orientation of the vector objects is modified.

Thus, for example, referring to FIG. 7 the application to vector objects 700 of an orientation modification tool operating in smoothing mode can give modified vector objects 710, in which the orientation of each of the affected objects is changed towards the local average value of the orientation attribute at the location of the respective object. A sharpening mode functions similarly—in such a mode, illustration program 130 applies a modification tool to change the attribute value or values of each affected vector object a vector object's attribute value away from the average value of the attribute.

In some implementations, illustration program 130 can be configured to modify attribute values by linear interpolation. In some implementations, linear interpolation can be used to compute a weighted average when an attribute is a scalar or a vector, as described in more detail below. Linear interpolation of the attributes of vector objects generally involves interpolating the corresponding attribute values of the particular attribute. Thus, for example, in linear interpolation of color attribute values, the respective colors are converted into the same color space, and the corresponding color components are interpolated. In one implementation, the interpolation of angles can be calculated as follows. To calculate the weighted average β of n angles $\alpha_{1\ n}$ with weights $w_{1\ n}$ the weighted average for their corresponding vectors can be computed by $[\cos \beta_1 \cdot w_1, \sin \beta_1 \cdot w_1]$, and the angle β of each corresponding vector can be calculated by:

$$\beta = \arctan\left(\frac{\sum_{i=1n} \sin\beta_i \cdot w_i}{\sum_{i=1n} \cos\beta_i \cdot w_i}\right)$$

Figure 8:
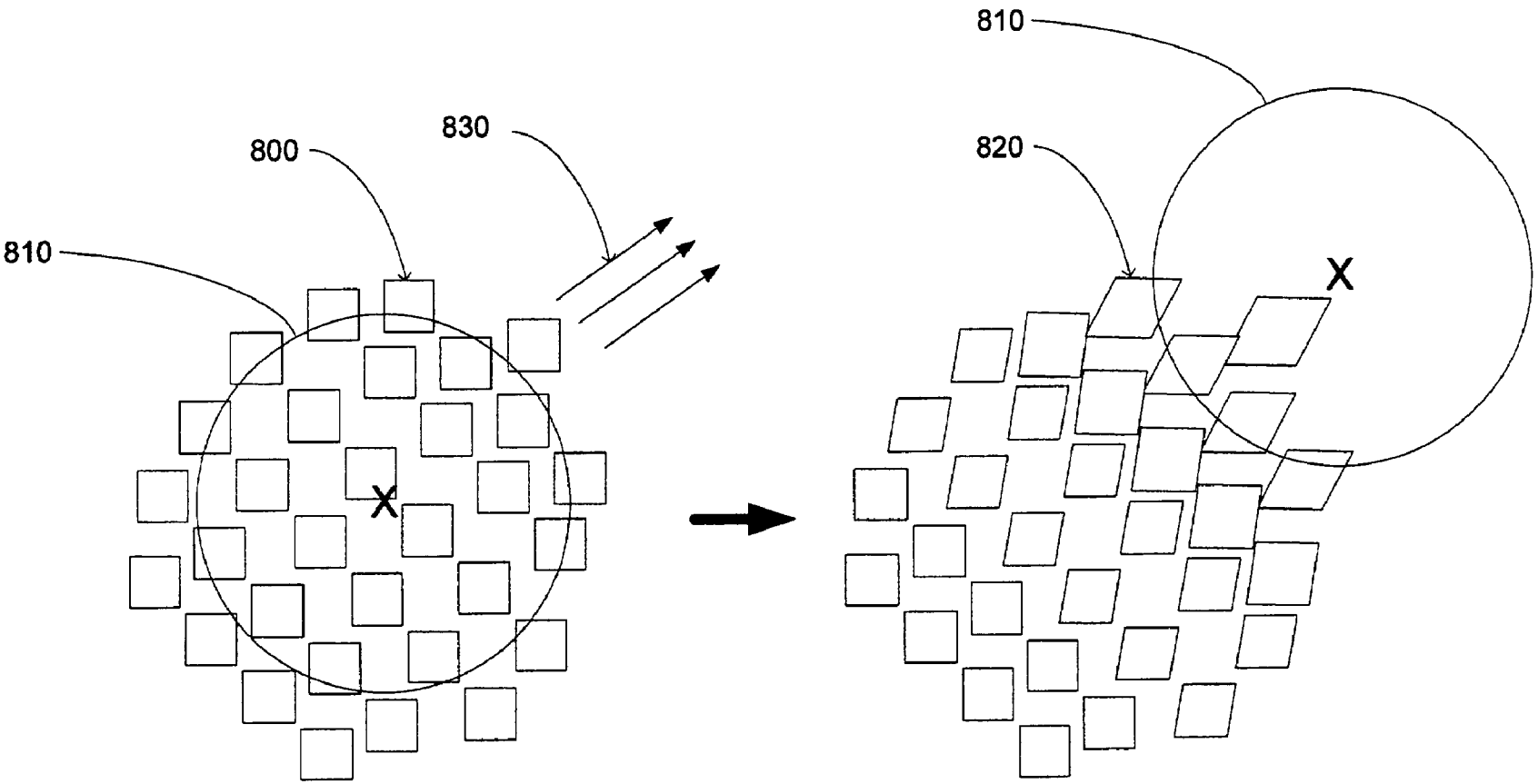
FIG. 8 illustrates the application of a modification tool to a collection of vector objects in a modification operation in which the oriented scale of the vector objects is modified.

The techniques described herein can be applied to a wide variety of attributes. Referring to FIG. 8, vector objects 800 can each have attribute values for an oriented scale attribute that defines a vector scale $<S_x, S_y>$ applied at an orientation alpha (α) as follows:

$$OrientedScale = \begin{bmatrix} \cos\alpha & \sin\alpha \\ -\sin\alpha & \cos\alpha \end{bmatrix} \times \begin{bmatrix} S_x & 0 \\ 0 & S_y \end{bmatrix} \times \begin{bmatrix} \cos\alpha & -\sin\alpha \\ \sin\alpha & \cos\alpha \end{bmatrix}$$

$$OrientedScale = \begin{bmatrix} \cos^2\alpha S_x + \sin^2\alpha S_y & \cos\alpha\sin\alpha S_y - \cos\alpha\sin\alpha S_x \\ \cos\alpha\sin\alpha S_y - \cos\alpha\sin\alpha S_x & \cos^2\alpha S_y + \sin^2\alpha S_x \end{bmatrix}$$

To compose multiple oriented-scales, the oriented scale matrices can be composed to obtain a result matrix which is of the form:

$$\begin{bmatrix} A & B \\ B & D \end{bmatrix}$$

Thus, the result α, $S_x$, and $S_y$ is given by the following:

$$\alpha = \frac{\left(\arctan\left(\frac{2B}{D-A}\right)\right)}{2} \quad S_y = \frac{\left(D + A + \frac{(D-A)}{\cos 2\alpha}\right)}{2} \quad S_x = D + A - S_y$$

where $A=\cos^2 \alpha S_x+\sin^2 \alpha S_y$, $B=\cos\alpha\sin\alpha S_y=\cos\alpha\sin\alpha S_x$, and $D=\cos^2 \alpha S_y+\sin^2 \alpha S_x$. In the example of FIG. 8, an oriented scale modification tool (represented here by a circular footprint 810) is applied to vector objects 800. In response, illustration program 130 calculates one or more new oriented scale attribute values (which could include one or both scale values and/or the orientation (or angle) at which the scale values are applied) for the affected vector objects, giving modified vector objects 820. Thus, for example, in one implementation illustration program 130 can be configured to define a new orientation value (or angle) at which the scale values are applied, i.e., an angle $\alpha$ based on the direction 830 in which the oriented scale modification tool is applied, with the result that the angle a for affected vector objects is changed based on the influence function. Alternatively, the angle a (or the scale values) can be changed based on other input associated with the application of the tool, such as the pressure applied to a pressure sensitive stylus or the time for which the tool is maintained in a particular location in the image.

The techniques can also be applied to a tinting attribute, which can be defined for each vector object by an associated tinting function, tint color, and tint amount. A tinting function takes an intrinsic color (e.g., the original color of the vector object) and a tint color and produces a result color. The final color can be calculated by interpolating the result color and the original color with the tint amount as follows:

$$\text{finalcolor}=(1-\text{tintAmount})\cdot\text{origColor}+\text{tintAmount}\cdot\text{tintfn}(\text{origColor, tintColor})$$

where finalColor is the final color computation of the tinting attribute, tintAmount is the tint amount, origColor is the original color, tintfn is the tinting function, and tintColor is the tint color, and tintfn(origColor, tintColor), produces the result color (which can be expressed as resultColor).

Figure 9:
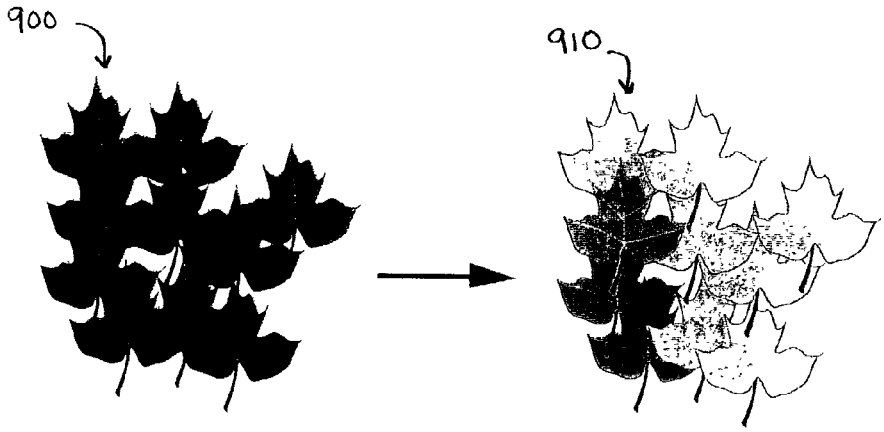
FIG. 9 illustrates the application of a modification tool to a collection of vector objects in a modification operation in which the tint of the vector objects is modified.

Referring to FIG. 9, for example, the application of a tint modification tool to vector objects 900 (which are originally green in color, and appearing as a constant shade in FIG. 9), can give modified vector objects 910 in which tinting attribute values are changed such that affected vector objects are tinted with a red tint (appearing as a lighter shade in FIG. 9). In another example, a tinting function can generate a result color that has the same hue as the tint color and the same luminosity as the intrinsic color. Tinting with this function allows for changing the colors of an object while preserving its shades. An object can include a group consisting of multiple objects with different intrinsic colors. The final (result) color of each object in a tinted group is a mix between the intrinsic (original) color of the object and the result of applying the tint function on it with the given tint color.

Figure 10:
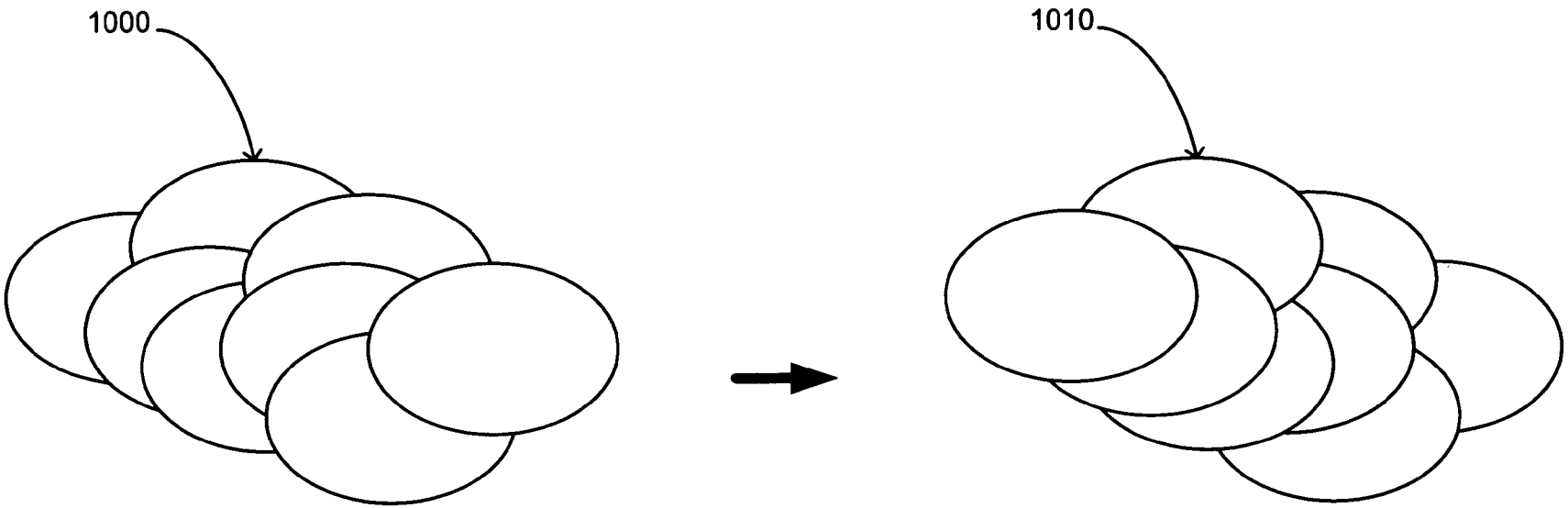
FIG. 10 illustrates the application of a modification tool to a collection of vector objects in a modification operation in which the paint order of the vector objects is modified.

The techniques can also be applied to vector objects having a paint-order attribute, as illustrated in FIG. 10. Vector objects 1000 are drawn in a paint order defined by paint order attribute values. Application of a paint order modification tool gives modified vector objects 1010, which are drawn in a new paint order, specified by modified paint order attribute values defined by the influence function of the modification tool.

The invention can be implemented in digital electronic circuitry, or in computer hardware, firmware, software, or in combinations of them. Apparatus of the invention may be implemented in a computer program product tangibly embodied in a machine-readable storage device for execution by a programmable processor; and method steps of the invention can be performed by a programmable processor executing a program of instructions to perform functions of the invention by operating on input data and generating output. The invention can be implemented advantageously in one or more computer programs that are executable on a programmable system including at least one programmable processor coupled to receive data and instructions from, and to transmit data and instructions to, a data storage system, at least one input device, and at least one output device. Each computer program can be implemented in a high-level procedural or object-oriented programming language, or in assembly or machine language if desired; and in any case, the language can be a compiled or interpreted language. Suitable processors include, by way of example, both general and special purpose microprocessors. Generally, a processor will receive instructions and data from a read-only memory and/or a random access memory. Generally, a computer will include one or more mass storage devices for storing data files; such devices include magnetic disks, such as internal hard disks and removable disks; magneto-optical disks; and optical disks. Storage devices suitable for tangibly embodying computer program instructions and data include all forms of non-volatile memory, including by way of example semiconductor memory devices, such as EPROM, EEPROM, and flash memory devices; magnetic disks such as internal hard disks and removable disks; magneto-optical disks; and CD-ROM disks. Any of the foregoing may be supplemented by, or incorporated in specially-designed ASICs (application-specific integrated circuits).

A number of embodiments of the invention have been described. Nevertheless, it will be understood that various modifications may be made without departing from the spirit and scope of the invention. For example, the order of performing steps of the methods described can be changed. Accordingly, other embodiments are within the scope of the following claims.

What is claimed is:

1. A computer-implemented method, comprising:

receiving user input selecting, positioning, and applying a modification operation to an image including one or more vector objects, the one or more vector objects having visual characteristics defined by one or more object-level attributes, each object-level attribute defining a corresponding visual characteristic of each of the vector objects independent of location within the vector object, the modification operation having a region of influence comprising multiple distinct location in the image and having an associated influence function defining a degree of change to be applied to the affected vector objects as a function of location relative to the region of influence;

identifying one or more vector objects to be affected by the modification operation, the one or more vector objects being identified based on their location in the image relative to the region of influence; and changing one or more attribute values for one or more of the object-level attributes of each identified vector object according to the modification operation, the degree of change for each of the identified vector objects being defined based at least in part on the influence function.

2. The method of claim 1, further comprising:

based on the user input, defining an intensity representing a strength of the modification operation at one or more locations in the region of influence; and wherein changing one or more attributes values for one or more of the object-level attributes of each identified vector object includes changing one or more attribute values based at least in part on the intensity.

3. The method of claim 2, wherein:

the region of influence is an aggregate region of influence, the influence function is an aggregate influence function, and the intensity is an aggregate intensity, the aggregate region of influence, aggregate influence function, and the aggregate intensity being defined based on a plurality of applications of a modification tool in the image; and changing one or more attributes values for one or more of the object-level attributes of each identified vector object includes changing one or more attribute values at a location in the image based at least in part on a value for the aggregate influence function and a value of the aggregate intensity defined for the location in the image.

4. The method of claim 1, further comprising:

receiving user input selecting one of a plurality of image processing modes, each of the image processing modes defining a method of changing attribute values for one or more of the object-level attributes; and wherein changing one or more attribute values for one or more of the object-level attributes of each identified vector object includes changing one or more attribute values based at least in part on the selected image processing mode.

5. The method of claim 4, wherein:

the plurality of image processing modes includes a randomization mode; and changing one or more attribute values for one or more of the object-level attributes of each identified vector object based at least in part on the selected image processing mode includes generating a random attribute value.

6. The method of claim 4, wherein:

changing one or more attribute values for one or more of the object-level attributes of each identified vector object based at least in part on the selected image processing mode includes changing one or more attribute values relative to an average attribute value of a object-level attribute.

7. The method of claim 6, wherein:

the plurality of image processing modes includes a smoothing mode; and changing one or more attribute values relative to an average attribute value of a object-level attribute includes changing one or more attribute values towards the average attribute value.

8. The method of claim 6, wherein:

the plurality of image processing modes includes a sharpen mode; and changing one or more attribute values relative to an average attribute value of a object-level attribute includes changing one or more attribute values away from the average attribute value.

9. The method of claim 6, wherein:

for a given vector object at a location in the image, the average attribute value for a object-level attribute is calculated by:

a) determining a distance in the image between the location of the vector object and a location of each of a plurality of other vector objects in the image; and b) calculating the average attribute value for the object-level attribute at the location of the vector object based on an attribute value for the object-level attribute for each of the plurality of other vector objects and the distance between the location of the vector object and the location of each of the plurality of other vector objects in the image.

10. The method of claim 1, wherein:

changing one or more attribute values for one or more of the object-level attributes of each identified vector object includes changing one or more attribute values for a plurality of object-level attributes of each identified vector object.

11. The method of claim 1, wherein:

the modification operation is operable to modify one or more object-level attributes selected from the group of object-level attributes consisting of color, tinting, size, orientation, oriented scale, style, transparency, and paint order.

12. The method of claim 1, wherein:

the influence function is defined by a mask to be applied to the image, such that the strength of the modification operation at a given location in the image is defined by a mask value for the given location.

13. The method of claim 1, wherein:

changing one or more attribute values for one or more of the object-level attributes of each identified vector object includes changing one or more attribute values for an oriented-scale attribute, the oriented-scale attribute including one or more scale values representing a size of the corresponding vector object and one or more orientation values representing angles at which the scale attribute values are to be applied to the corresponding vector object.

14. The method of claim 1, wherein:

changing one or more attribute values for one or more of the object-level attributes of each identified vector object includes changing one or more attribute values for a tinting attribute, the tinting attribute including for a given vector object a tint color value defining a tint color, a tinting-amount value defining a degree of tinting to be applied to the vector object, and a tinting function defining a result color for the vector object as a function of the tint color value of the vector object and an original color value of the color attribute of the vector object, such that the tinting attribute of the one or more tinted colors for a given vector object can be applied to generate one or more tinted colors for the vector object based on the original color values of the vector object, the tinting function and the tinting-amount.

15. The method of claim 14, wherein changing one or more attribute values for a tinting attribute includes interpolating between the original color value of each of the vector object's color attribute and the result color defined by the tinting function using the tinting amount according to the formula:

$$\text{finalColor}=(1-\text{tintAmount})\cdot\text{origColor}+\text{tintAmount}\cdot\text{resultColor},$$

where finalColor is a value of the generated tint color, tintAmount is the tinting-amount, origColor is the original color value, and resultColor is the result color value produced by the tinting function.

16. The method of claim 1, wherein:

changing one or more attribute values for one or more of the object-level attributes of each identified vector object includes changing one or more attribute values for a paint-order attribute, the paint-order attribute including one or more attribute values defining the order in which the vector object is painted in the group of vector objects when rendering the image.

17. The method of claim 1, wherein:

the user input includes input representing manipulation by a user of a modification tool defining the modification operation; and the method further comprising providing feedback to the user of the changing attribute values.

18. The method of claim 17, wherein providing feedback to the user includes:

displaying a temporary visual representation of an attribute value for a vector object within a footprint of the modification tool; and changing the visual representation of the attribute value in response to the user's manipulation of the modification tool.

19. The method of claim 1, wherein:

the influence function is defined in part by attribute values of a user-selected object in the image.

20. The method of claim 1, wherein:

the user input applying the modification operation defines one or more values for an input parameter derived from the user input; and changing one or more attribute values for one or more of the object-level attributes of each identified vector object includes calculating one or more new attribute values for each identified vector object based at least in part on a value of the input parameter defined at the location of the identified vector object in the image.

21. The method of claim 20, wherein:

the input parameter includes one of direction, speed, pressure, and tilt.

22. The method of claim 1, wherein the one or more attributes are vectors.

23. A computer-implemented method, comprising:

receiving user input selecting, positioning, and applying a modification operation to an image including one or more vector objects, the one or more vector objects having visual characteristics defined by one or more attributes, the modification operation having a region of influence in the image and having an associated influence function defining a degree of change to be applied to the affected vector objects as a function of location relative to the region of influence comprising multiple distinct locations;

receiving user input selecting one of a plurality of image processing modes, each of the image processing modes defining a method of changing attribute values for of one or more of the attributes;

identifying one or more vector objects to be affected by the modification operation, the one or more vector objects being identified based on their location in the image relative to the region of influence; and changing one or more attribute values for one or more of the attributes of each identified vector object according to the modification operation and the selected image processing mode, the degree of change for each of the identified vector objects being defined based at least in part on the influence function and the method of changing attribute values for one or more of the attributes.

24. The method of claim 23, wherein:

the plurality of image processing modes includes a randomization mode; and changing one or more attribute values for one or more of the attributes of each identified vector object according to the selected image processing mode includes generating a random attribute value.

25. The method of claim 23, wherein:

changing one or more attribute values for one or more of the attributes of each identified vector object according to the selected image processing mode includes changing one or more attribute values relative to an average attribute value of an attribute.

26. The method of claim 25, wherein:

the plurality of image processing modes includes a smoothing mode; and changing one or more attribute values for one or more of the attributes of each identified vector object relative to an average attribute value includes changing one or more attribute values towards the average attribute value.

27. The method of claim 25, wherein:

the plurality of image processing modes includes a sharpen mode; and changing one or more attribute values for one or more of the attributes of each identified vector object relative to an average attribute value includes changing one or more attribute values away from the average attribute value.

28. The method of claim 25, wherein:

for a given vector object at a location in the image, the average attribute value for an attribute is calculated by:

a) determining a distance in the image between the location of the vector object and a location of each of a plurality of other vector objects in the image; and b) calculating the average attribute value for the attribute at the location of the vector object based on an attribute value for the attribute for each of the plurality of other vector objects and the distance between the location of the vector object and the location of each of the plurality of other vector objects in the image.

29. The method of claim 23, wherein the one or more attributes are vectors.

30. A computer program product, tangibly stored on a computer-readable medium, the product comprising instructions operable to cause a programmable processor to:

receive user input selecting, positioning, and applying a modification operation to an image including one or more vector objects, the one or more vector objects having visual characteristics defined by one or more object-level attributes, each object-level attribute defining a corresponding visual characteristic of each of the vector objects independent of location within the vector object, the modification operation having a region of influence comprising multiple distinct locations in the image and having an associated influence function defining a degree of change to be applied to the affected vector objects as a function of location relative to the region of influence;

identify one or more vector objects to be affected by the modification operation, the one or more vector objects being identified based on their location in the image relative to the region of influence; and change one or more attribute values for one or more of the object-level attributes of each identified vector object according to the modification operation, the degree of change for each of the identified vector objects being defined based at least in part on the influence function.

31. The computer program product of claim 30, wherein the computer program product further comprises instructions operable to cause a programmable processor to:

based on the user input, define an intensity representing a strength of the modification operation at one or more locations in the region of influence; and wherein the instructions operable to cause a programmable processor to change one or more attribute values for one or more of the object-level attributes of each identified vector object include instructions operable to cause a programmable processor to change one or more attribute values based at least in part on the intensity.

32. The computer program product of claim 31, wherein:

the region of influence is an aggregate region of influence, the influence function is an aggregate influence function, and the intensity is an aggregate intensity, the aggregate region of influence, aggregate influence function, and the aggregate intensity being defined based on a plurality of applications of a modification tool in the image; and the instructions operable to cause a programmable processor to change one or more attribute values for one or more of the object-level attributes of each identified vector object include instructions operable to cause a programmable processor to change one or more attribute values at a location in the image based at least in part on a value for the aggregate influence function and a value of the aggregate intensity defined for the location in the image.

33. The computer program product of claim 30, wherein the computer program product further comprises instructions operable to cause a programmable processor to:

receive user input selecting one of a plurality of image processing modes, each of the image processing modes defining a method of changing attribute values for of one or more of the object-level attributes; and wherein the instructions operable to cause a programmable processor to change one or more attribute values for one or more of the object-level attributes of each identified vector object include instructions operable to cause a programmable processor to change one or more attribute values based at least in part on the selected image processing mode.

34. The computer program product of claim 33, wherein:

the plurality of image processing modes includes a randomization mode; and the instructions operable to cause a programmable processor to change one or more attribute values for one or more of the object-level attributes of each identified vector object based at least in part on the selected image processing mode include instructions operable to cause a programmable processor to generate a random attribute value.

35. The computer program product of claim 33, wherein the instructions operable to change one or more attribute values for one or more of the object-level attributes of each identified vector object based at least in part on the selected image processing mode include instructions operable to cause a programmable processor to change one or more attribute values relative to an average attribute value of a object-level attribute.

36. The computer program product of claim 35, wherein:

the plurality of image processing modes includes a smoothing mode; and the instructions operable to cause a programmable processor to change one or more attribute values relative to an average attribute value of a object-level attribute include instructions operable to cause a programmable processor to change one or more attribute values towards the average attribute value.

37. The computer program product of claim 35, wherein:

the plurality of image processing modes includes a sharpen mode; and the instructions operable to cause a programmable processor to change one or more attribute values relative to an average attribute value of a object-level attribute include instructions operable to cause a programmable processor to change one or more attribute values away from the average attribute value.

38. The computer program product of claim 35, wherein:

for a given vector object at a location in the image, the average attribute value for a object-level attribute is calculated by:

a) determining a distance in the image between the location of the vector object and a location of each of a plurality of other vector objects in the image; and b) calculating the average attribute value for the object-level attribute at the location of the vector object based on an attribute value for the object-level attribute for each of the plurality of other vector objects and the distance between the location of the vector object and the location of each of the plurality of other vector objects in the image.

39. The computer program product of claim 30, wherein the instructions operable to change one or more attribute values for one or more of the object-level attributes of each identified vector object include instructions operable to cause a programmable processor to change one or more attribute values for a plurality of object-level attributes of each identified vector object.

40. The computer program product of claim 30, wherein:

the modification operation is operable to modify one or more object-level attributes selected from the group of object-level attributes consisting of color, tinting, size, orientation, oriented scale, style, transparency, and paint order.

41. The computer program product of claim 30, wherein:

the influence function is defined by a mask to be applied to the image, such that the strength of the modification operation at a given location in the image is defined by a mask value for the given location.

42. The computer program product of claim 30, wherein the instructions operable to change one or more attribute values for one or more of the object-level attributes of each identified vector object include instructions operable to cause a programmable processor to change one or more attribute values for an oriented-scale attribute, the oriented-scale attribute including one or more scale values representing a size of the corresponding vector object and one or more orientation values representing angles at which the scale attribute values are to be applied to the corresponding vector object.

43. The computer program product of claim 30, wherein the instructions operable to change one or more attribute values for one or more of the object-level attributes of each identified vector object include instructions operable to cause a programmable processor to change one or more attribute values for a tinting attribute, the tinting attribute including for a given vector object a tint color value defining a tint color, a tinting-amount value defining a degree of tinting to be applied to the vector object, and a tinting function defining a result color for the vector object as a function of the tint color value of the vector object and an original color value of the color attribute of the vector object, such that the tinting attribute of the one or more tinted colors for a given vector object can be applied to generate one or more tinted colors for the vector object based on the original color values of the vector object, the tinting function and the tinting-amount.

44. The computer program product of claim 43, wherein the instructions operable to change one or more attribute values for a tinting attribute include instructions operable to cause a programmable processor to interpolate between the original color value of each of the vector object's color attribute and the result color defined by the tinting function using the tinting amount according to the formula:

$$finalColor=(1-tintAmount)*origColor+tintAmount*resultcolor,$$

where finalColor is a value of the generated tint color, tintAmount is the tinting-amount, origColor is the original color value, and resultColor is the result color value produced by the tinting function.

45. The computer program product of claim 30, wherein the instructions operable to change one or more attribute values for one or more of the object-level attributes of each identified vector object include instructions operable to cause a programmable processor to change one or more attribute values for a paint-order attribute, the paint-order attribute including one or more attribute values defining the order in which the vector object is painted in the group of vector objects when rendering the image.

46. The computer program product of claim 30, wherein:

the user input includes input representing manipulation by a user of a modification tool defining the modification operation; and the computer program product further comprising instructions operable to cause a programmable processor to provide feedback to the user of the changing attribute values.

47. The computer program product of claim 46, wherein the instructions operable to provide feedback to the user include instructions operable to cause a programmable processor to:

display a temporary visual representation of an attribute value for a vector object within a footprint of the modification tool; and change the visual representation of the attribute value in response to the user's manipulation of the modification tool.

48. The computer program product of claim 30, wherein:

the influence function is defined at least in part by attribute values of a user-selected object in the image.

49. The computer program product of claim 30, wherein:

the user input applying the modification operation defines one or more values for an input parameter derived from the user input; and the instructions operable to cause a programmable processor to change one or more attribute values for one or more of the object-level attributes of each identified vector object include instructions operable to cause a programmable processor to calculate one or more new attribute values for each identified vector object based at least in part on a value of the input parameter defined at the location of the identified vector object in the image.

50. The computer program product of claim 49, wherein:

the input parameter includes one of direction, speed, pressure, and tilt.

51. The computer program product of claim 30, wherein:

the one or more object-level attributes are vectors.

52. A computer program product, tangibly stored on a computer-readable medium, the product comprising instructions operable to cause a programmable processor to:

receive user input selecting, positioning, and applying a modification operation in an image including one or more vector objects, the one or more vector objects having visual characteristics defined by one or more attributes, the modification operation having a region of influence comprising multiple distinct locations in the image and having an associated influence function defining a degree of change to be applied to the affected vector objects as a function of location relative to the region of influence;

receive user input selecting one of a plurality of image processing modes, each of the image processing modes defining a method of changing attribute values for of one or more of the attributes;

identify one or more vector objects to be affected by the modification operation, the one or more vector objects being identified based on their location in the image relative to the region of influence; and change one or more attribute values for one or more of the attributes of each identified vector object according to the modification operation and the selected image processing mode, the degree of change for each of the identified vector objects being defined based at least in part on the influence function and the method of changing attribute values for one or more of the attributes.

53. The computer program product of claim 52, wherein:

the plurality of image processing modes includes a randomization mode; and the instructions operable to cause a programmable processor to change one or more attribute values for one or more of the attributes of each identified vector object according to the selected image processing mode include instructions operable to cause a programmable processor to generate a random attribute value.

54. The computer program product of claim 52, wherein the instructions operable to change one or more attribute values for one or more of the attributes of each identified vector object according to the selected image processing mode include instructions operable to cause a programmable processor to change one or more attribute values relative to an average attribute value of an attribute.

55. The computer program product of claim 54, wherein:

the plurality of image processing modes includes a smoothing mode; and the instructions operable to cause a programmable processor to change one or more attribute values for one or more of the attributes of each identified vector object relative to an average attribute value include instructions operable to cause a programmable processor to change one or more attribute values towards the average attribute value.

56. The computer program product of claim 54, wherein:

the plurality of image processing modes includes a sharpen mode; and the instructions operable to cause a programmable processor to change one or more attribute values for one or more of the attributes of each identified vector object relative to an average attribute value include instructions operable to cause a programmable processor to change one or more attribute values away from the average attribute value.

57. The computer program product of claim 54, wherein:

for a given vector object at a location in the image, the average attribute value for an attribute is calculated by:

a) determining a distance in the image between the location of the vector object and a location of each of a plurality of other vector objects in the image; and b) calculating the average attribute value for the attribute at the location of the vector object based on an attribute value for the attribute for each of the plurality of other vector objects and the distance between the location of the vector object and the location of each of the plurality of other vector objects in the image.

58. The computer program product of claim 52, wherein: the one or more attributes are vectors.

* * * * *

UNITED STATES PATENT AND TRADEMARK OFFICE

CERTIFICATE OF CORRECTION

PATENT NO. : 7,123,269 B1 
APPLICATION NO. : 10/177925
DATED : October 17, 2006
INVENTOR(S) : Lubomir D. Bourdev and Martin E. Newell It is certified that error appears in the above-identified patent and that said Letters Patent is hereby corrected as shown below:

Title Page at sections (12) and (75), please correct the first named invenor's last name to read --Bourdev--.

Column 14, line 45, delete "location" and replace with --locations--;
Column 17, line 41, after the first occurrence of "influence", insert --comprising multiple distinct locations--;
lines 45-46, delete "comprising multiple distinct locations";
line 49, delete second occurrence of "of";
Column 19, line 32, delete second occurrence of "of";
Column 22, line 13, delete second occurrence of "of"';

Signed and Sealed this

Twenty-seventh Day of February, 2007

JON W. DUDAS
*Director of the United States Patent and Trademark Office*